US007896110B2

(12) United States Patent
Bain

(10) Patent No.: US 7,896,110 B2
(45) Date of Patent: Mar. 1, 2011

(54) SHOE

(75) Inventor: James Bain, Inverbervie Montrose Angus (GB)

(73) Assignee: Caledus Limited, Aberdeen (GB)

( * ) Notice: Subject to any disclaimer, the term of this patent is extended or adjusted under 35 U.S.C. 154(b) by 207 days.

(21) Appl. No.: 10/598,365

(22) PCT Filed: Feb. 24, 2005

(86) PCT No.: PCT/GB2005/000661

§ 371 (c)(1),
(2), (4) Date: Jun. 17, 2008

(87) PCT Pub. No.: WO2005/083226

PCT Pub. Date: Sep. 9, 2005

(65) Prior Publication Data

US 2008/0236813 A1 Oct. 2, 2008

(30) Foreign Application Priority Data

Feb. 25, 2004 (GB) ..... 0404170.3

(51) Int. Cl.
*E21B 17/14* (2006.01)

(52) U.S. Cl. ..... 175/402; 166/242.8; 175/325.1

(58) Field of Classification Search ..... 166/242.8; 175/402, 406, 325.1
See application file for complete search history.

(56) References Cited

U.S. PATENT DOCUMENTS

| | | | | |
|---|---|---|---|---|
| 4,467,879 | A | 8/1984 | Burge et al. | |
| 6,062,326 | A | 5/2000 | Strong | |
| 6,401,820 | B1 | 6/2002 | Kirk | |
| 6,808,019 | B1 * | 10/2004 | Mabry | 166/176 |
| 2002/0189863 | A1 * | 12/2002 | Wardley | 175/21 |
| 2003/0075364 | A1 | 4/2003 | Wardley | |
| 2003/0106719 | A1 * | 6/2003 | Herrera | 175/325.2 |

FOREIGN PATENT DOCUMENTS

| | | |
|---|---|---|
| WO | 01/83932 | 11/2001 |
| WO | 01/98621 | 12/2001 |

* cited by examiner

*Primary Examiner*—Giovanna C Wright
(74) *Attorney, Agent, or Firm*—Daniel N. Lundeen; Lundeen & Lundeen PLLC

(57) ABSTRACT

A tubing shoe (10) for use on work strings in well bores as are typically utilised in oil and gas production. The shoe comprises a cylindrical body (12) upon which is arranged a reaming portion (22) including pairs of teardrop shaped raised reaming members (26), each pair being mounted oppositely, in parallel and longitudinally along the body. Adjacent pairs of members provide a funnel (42) for collecting approaching debris and a channel for grinding the debris. A nose (14) may be mounted on the end of the shoe, the nose being eccentric or including cutting blades to assist the shoe in breaking through shale and clay stone bridges. A non-aggressive stabiliser (54) in the form of helically arranged blades may also be located on shoe.

29 Claims, 2 Drawing Sheets

SHOE

CROSS REFERENCE TO RELATED APPLICATIONS

This application claims priority to United Kingdom patent application no. 0404170.3, filed 25 Feb. 2004, and International Application filed under the Patent Cooperation Treaty, application no. PCT/GB2005/000661, filed 24 Feb. 2005.

BACKGROUND OF THE INVENTION

The present invention relates to a tubing shoe for use in well bores as are typically utilised in oil and gas production.

After boring or drilling a region of an oil or gas well a "string" of tools and/or tubing is typically run into the well bore. As the string is run it can meet obstructions as it travels through the well bore. These obstructions may be ledges that form from well material during boring, formation wash-outs, or debris formed by unstable sections of the well bore wall collapsing. Bridges of shale and clay stone can also be formed. Such obstructions can result in the string jamming in the well bore.

To prevent or minimise the effect of these obstructions, a guide shoe is conventionally mounted on the lower end of the string.

For example, after boring a region of an oil or gas well, it is normal to run tubing or casing into the well bore to act as a lining. The casing is typically run into the well bore from the surface and the length of casing is often referred to as a "casing string". The lining of the well bore can then be strengthened by introducing cement between the external surface of the casing and the internal surface of the well bore. As the casing is run there is a risk of the casing string jamming as it meets obstructions in the well bore. To prevent or minimise the effect of the obstructions, a guide shoe, referred to as a reamer shoe, is conventionally mounted on the lower end of the casing string.

A typical reamer shoe has two features; a nose portion designed to guide the casing through the centre of the wellbore, so reducing the risk of the casing string jamming against the bore wall, and a reaming portion around the body of the shoe which removes any irregularities or obstructions from the wall of the bore, and thereby ease the passage of the casing string. When the casing is successfully positioned and set in place, the nose portion may be drilled out to leave a through-bore for the passage of tools to drill and case the next section of the well bore. The dual purpose of the shoe requires that the material of the nose cone is soft, and therefore easily able to be drilled out and the material of the reaming portion must be hard, so that it can successfully remove obstructions on the wall of the bore. Ideally, the shoes are constructed of two materials; a body comprising the reamer is made of a hard material, such as steel, while the nose portion is made of a soft material, such as aluminium. The shoes are typically a two-part construction, with the nose portion screwed into an annular sleeve that includes the reamers.

Reamer shoes generally may be used in two modes; the casing string and reamer shoe may be rotated and advanced in the manner of a drilling operation, alternatively the casing string and the reamer shoe may be reciprocated to provide a rasping action against partial obstruction in the well bore. In general, the reciprocating mode would be preferable when the threaded casing connections are considered too weak to support the rotational torsion required to turn and ream away at obstructions. In order that a single design of reamer shoe may be conveniently used in either manner, certain combinations of features have been brought together in a single unit. It will be seen that although these combinations improve performance in certain aspects, they compromise performance in other aspects.

Certain reamer shoes incorporate helical reaming members giving full circumferential coverage to assist in rasping the entire bore hole wall when operated in the reciprocating mode. An example of such a shoe is that disclosed in U.S. Pat. No. 6,401,820. This feature may be seen to be detrimental in certain circumstances by reference to the manner in which casing joints are mated together. Casing joints are invariably threaded and screwed together prior to running into the well bore. It will be appreciated that upon engaging an obstruction and attempting to overcome it by reciprocation, a helical reaming member will inevitably impart a rotational action to the casing string as it slides over and past the obstruction. Depending on whether the helical reaming member is clockwise or anti-clockwise, the reamer shoe may impart a tightening or untightening torsion to the threaded connections higher up in the casing string. As has been stated, threaded casing connections may be relatively weak and could be damage if over-tightened. Conversely, if rotated in the opposite direction, the connections may be loosened. Either outcome is undesirable and could result in serious consequences for the well bore construction operation.

A further undesirable consequence of anti-clockwise helical reaming members may be apparent when this style of reamer shoe is used in the normal clockwise rotational mode. The rotating helical members impart a restraining influence on the flow of well bore fluid and in particular on the solid components entrained in the fluid, generated by the reaming process. The result is a gradual increase in the concentration of solid material ahead of the reaming elements that can pack-off the reaming area, rendering it ineffective. In order to clean the reaming members it may be necessary to pick-up the reamer shoe and circulate fluid at a high rate, if this is unsuccessful, then the reamer shoe along with the entire casing string would have to be removed from the well bore. It will be appreciated that this is a highly undesirable operation.

Another design of reamer shoe uses multiple diamond-shaped reaming members to overcome the negative aspects of the helical reaming design. US 2003/0075364 provides an example of diamond-shaped reaming members. A feature of this design is that each reaming element has a leading edge. It will be apparent to those skilled in the art, that the leading edge of each element is a potential site for hanging-up whilst tripping into the well bore. Hanging-up is a phenomenon where tools that ideally can be run into a well bore with a smooth and uninterrupted action, may intermittently come to a halt when sudden changes in a section of the tool string and of the well bore come into contact. Hanging-up is at best an inconvenience, at worst, it can result in the entire casing string being pulled from the well to investigate the cause of the problem.

Yet another design of reamer shoe uses a reaming structure that converges towards the forward end of the nose of the reamer shoe. This design is illustrated in U.S. Pat. No. 6,062,326. One undesirable consequence of this design is that relatively large pieces of well bore formation may pass by the reaming members without being ground-up. If these pieces exceed a certain size, they may not be carried back to the surface by the flow of well bore fluid. In this event, they can fall back to the upper end of the reamer shoe and collect there. There are certain common circumstances where this may be an undesirable outcome. Firstly, after reaming to the bottom of the well bore, it is normal practice to cement at least the lower section of the casing string, including the reamer shoe itself, in place. In order that a good strong cement bond is made it is important that the well bore fluid along with contaminants such as cuttings are circulated out before the cement is put in place. With large pieces of well bore formation collecting above the reamer shoe, this may not be possible. The outcome could be a contaminated and therefore weak cement bond. Secondly, if it were necessary to reciprocate the casing string when the upper part of the reamer shoe had a collection of cuttings above it, it could be seen that on the upstroke the cuttings would become jammed between the reamer shoe and the hole-wall. In the worst circumstances, it may not be possible to free the reamer shoe and the casing would have to be set in the position that it became jammed.

It is an object of the present invention to provide a shoe that overcomes these and other limitations of existing shoes.

BRIEF SUMMARY OF THE INVENTION

According to a first aspect of the present invention there is provided a shoe for use on the end of a work string within a well bore, the shoe comprising a generally cylindrical body having a first end adapted for connection to the work string and a second end including a nose portion; the nose portion including a rounded head distal to the body for advancement through the well bore; the body having thereupon a reaming portion located behind the nose portion wherein the reaming portion comprises a plurality of raised members, each pair of raised members being mounted oppositely, in parallel and longitudinally along the body, wherein each adjacent pair of members provides a funnel for collecting approaching debris and a channel for grinding the debris.

In this way the leading portions of the reaming members have diverging edges, stopping large pieces of formation being circulated through the tool. All pieces above a certain sizes will necessarily be ground up before being allowed to exit the reaming portion. In addition by making the members non-helical and extend the length of the reaming portion, the shoe operates well in both rotation and reciprocation.

Preferably the reaming members are elongate and continuous. Preferably also, the reaming members are teardrop shaped. In this way, one end of each reaming member is wider than the opposing end and both ends are rounded.

Preferably the funnel comprises diverging edges of adjacent reaming members. Preferably the channel provided between each pair of members converges from the nose portion along the reaming portion. This improves the grinding and breaking down ability of the shoe without compromising the flow by area provided by the channels. The funnel will guide flow and debris into the channel.

Preferably the nose portion is eccentric to aid the passage of the shoe through the well bore. In this way the nose has an end offset from the central axis of the shoe. Advantageously the nose portion includes one or more ports. The ports may direct fluid within the shoe, forward of the shoe or rearwards over the reaming members. In one embodiment of the shoe, the nose portion includes a plurality of blades extending from the end of the nose towards the reaming portion. The blades may include a cutting surface to assist in breaking through shale and clay stone bridges.

The shoe may further comprises a gauge portion. Preferably the gauge portion is located furthest from the nose portion. Preferably the gauge portion is a stabiliser. More preferably the gauge portion comprises a plurality of elongate blades. Advantageously the blades are arranged helically along the body. In this way a non-aggressive stabiliser is provided on the shoe.

According to a second aspect of the present invention there is provided a shoe for use on the end of a work string within a well bore, the shoe comprising a generally cylindrical body having a first end adapted for connection to the work string and a second end including a nose portion; the nose portion including a rounded head distal to the body for advancement through the well bore and a plurality of blades extending from the head towards the body; the body having thereupon a reaming portion located behind the nose portion wherein the reaming portion comprises a plurality of discrete raised members to ream the bore.

The reaming members may be arranged in any configuration on the reaming portion. The shoe therefore advantageously 'cuts through' and debris or blockage in the well bore prior to reaming the bore. Preferably the reaming members are as described with reference to the first aspect. In this way the reaming members provide complete circumferential coverage of the body, are continuous and extend fully along the reaming portion.

Preferably the shoe is constructed from a combination of relatively hard and relatively soft materials. In this way the blades and reaming portions can effective at cutting through debris and reaming the bore while the shoe can be drilled through when necessary.

The shoe may further comprises a gauge portion. Preferably the gauge portion is located furthest from the nose portion. Preferably the gauge portion is a stabiliser. More preferably the gauge portion comprises a plurality of elongate blades. Advantageously the blades are arranged helically along the body. In this way a non-aggressive stabiliser is provided on the shoe.

BRIEF DESCRIPTION OF THE SEVERAL VIEWS OF THE DRAWINGS

Embodiments of the present invention will now be described, by way of example only, with reference to the accompanying drawings of which.

DETAILED DESCRIPTION OF THE INVENTION

Figure 1:
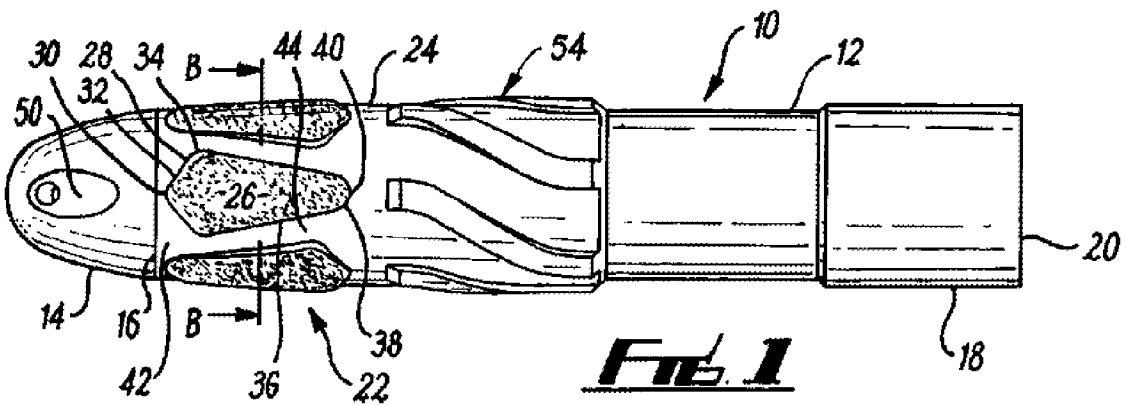
FIG. 1 is a schematic side view of a shoe according to a first embodiment of the present invention.

Reference is initially made to FIG. 1 of the drawings which illustrates a shoe, generally indicated by reference numeral 10, according to a first embodiment of the present invention. Shoe 10 comprises a generally cylindrical body 12 having a nose portion 14 at a first end 16 and a connector 18 at a second end 20. Connector 18 is adapted to mount the shoe 10 on a work string (not shown). Connector 18 is typically a threaded connector as is known in the art.

Behind the nose portion 14 is located a reaming portion 22. This portion 22 is a longitudinally arranged section on the outer surface 24 of the body 12. Mounted on the surface 24 are six reaming members 26*a-f*. The reaming members 26 are constructed from a hard resistant material such as polycrystalline diamond compact or tungsten carbide, or a combination of both materials.

Each reaming member 26 has a teardrop shape. This provides a first end 28 having an apex 30. Diverging from the apex 30 are sloping edges 32. The edges 32 then turn at a corner 34 to provide longitudinally extending convergent edges 36 which terminate at a rounded corner 38. The rounded corner 38 is at a second end 40 of the reaming portion 26, opposite the first end 28 and at the end of the reaming portion 22.

Figure 2:
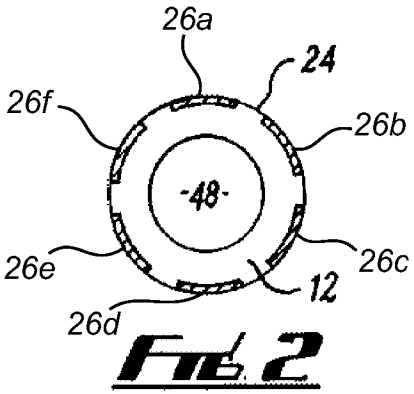
FIG. 2 is a cross-sectional view through the shoe of FIG. 1 at section B-B.

As further illustrated with the aid of FIG. 2, the reaming members 26 are oppositely arranged, in pairs, circumferentially around the outer surface 24. In lying side by side, a funnel 42 is created toward the nose 14 of the reaming portion 22. Debris, fluid and the like is effectively guided by the funnel arrangement 42 bounded by the edges 28,36. This matter is then ground up as it passes through a channel 44 between adjacent edges 36 of the reaming members 26. The edges 36 converge towards the second end 40. Though six reaming members 26 are illustrated, it will be appreciated that any even number of members 26 could be used.

This arrangement of reaming members 26 work effectively in both the rotating and reciprocation modes the shoe may be used in. Additionally sufficient flow area is provided around the members 26 to ensure that cuttings are effectively swept down the side of the shoe while being ground in the channels 44. A typical flow area is 65% of the circumferential area at the members 26, as illustrated in FIG. 2.

Figure 3:
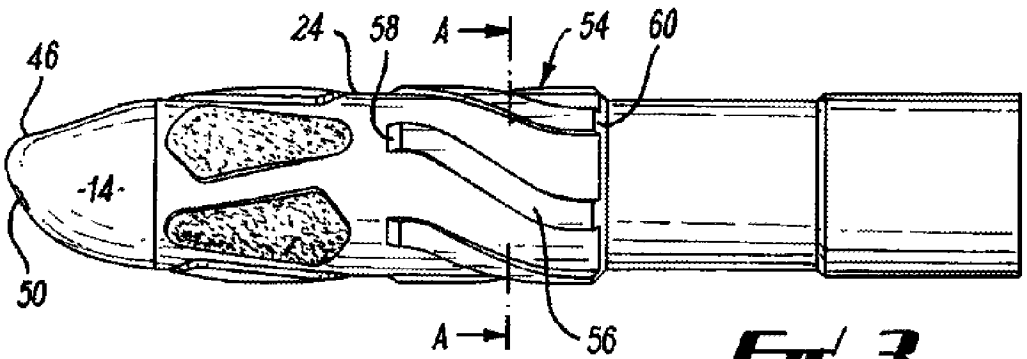
FIG. 3 is an alternative side view of the shoe of FIG. 1.
Figure 4:
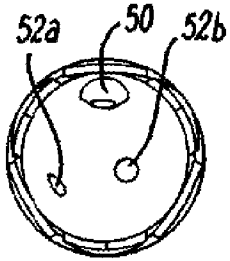
FIG. 4 is a front view of the shoe of FIG. 3.

Reference is now made to FIGS. 3 and 4 which, with FIG. 1, illustrate the nose portion 14 of the shoe 10. Like parts to those in FIG. 1 have been given the same reference numerals to aid clarity. Nose portion 14 is an eccentric portion connected to the front 16 of the shoe 10. The nose 14 has a snubbed end 46, rounded to provide guide for the shoe 10 through a well bore. Nose 14 may be rotatably mounted to the body 12.

Body 12 is hollow having a bore 48 there through. Fluid such as drilling fluid may be pumped towards the shoe through the bore 48. Upon the nose 14 is a jetting port 50 which allows the fluid to exit the shoe 10 and lubricate the advancing nose through the well bore. Additionally rearwardly directed ports 52*a,b* are positioned on the nose 14. These ports 52*a,b* direct fluid back to the reaming members 26 to aid the clearing of cuttings and debris in the channels 44. The ports 50,52 are all recessed and do not lie on the central axis of the nose portion 14.

The nose 14 is typically formed of a relatively soft material such as an aluminium alloy. The material is chosen so that a drill may be passed through the bore 48 and the nose 14 drilled through when the shoe has completed its task.

Figure 5:
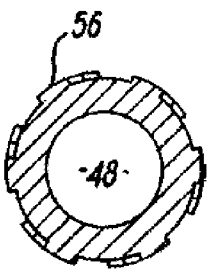
FIG. 5 is a cross-sectional view through the shoe of FIG. 3 at section A-A.

Mounted behind the reaming section is a stabiliser portion, generally indicated by reference numeral 54. The stabiliser may be used to provide a particular directional response from the tool or to act as a pivot point to assist the shoe in negotiating obstacles. As illustrated in FIGS. 3 and 5, stabiliser 54 comprises six spiral flutes 56 arranged on the outer surface 24 of the body 12. Each flute 56 is an elongate band arranged substantially helically on the surface 24. While six flutes 56 are illustrated any number of flutes 56 may be used. It may however, be advantageous to have the same number of flutes 56 as reaming members 26 and align the leading edge 58 of each flute with the end 30,40 of each reaming portion 26. In this way a series of generally uninterrupted flow paths are provided along the length of The shoe 10.

The outer faces of the flutes 56 may also be provided with a hard facing of tungsten carbide or the like and their trailing ends 60 may also provided with abrasive elements, such as aggressive tungsten carbide, to assist back-reaming. The forward ends 58 of the spiral flutes 56 may similarly be provided with abrasive elements, to protect the flutes from damage during forward motion of the shoe.

In use, the shoe 10 may be located on a lower end of a length of tubing, typically liner, which is then run into a well bore. The upper section of the bore will have been previously lined with steel casing, such that initial passage of the shoe and liner into the bore should be relatively straightforward. However, as the shoe 10 and the leading end of the liner move into the lower unlined part of the bore, the shoe 10 is likely to encounter ledges, deposits of cuttings, and other obstructions. These may be dislodged or pushed aside by the shoe 10, or the fluid passing from the shoe 10. However, on occasion it may be necessary to rasp or ream past an obstruction using the reaming members 26. This may be achieved by rotating the liner and shoe 10 in either direction so that the reaming members 26 rasp or ream the obstruction to an extent that the shoe 10 and the liner may pass. The shoe 10 may also be reciprocated to aid passage passed an obstruction. The divergent edges 32,36 prevent hanging-up and stop larger pieces of debris being circulated through the shoe 10. All pieces above a certain size will be forced toward the channel 44, by the funnel 42, and ground-up before exiting the reaming portion at an upper end of the shoe. Once the liner is in place, a drill may be inserted in the bore 48 and the nose portion 14 drilled through. This will provide a clear bore through the liner and the shoe 10.

Figure 6:
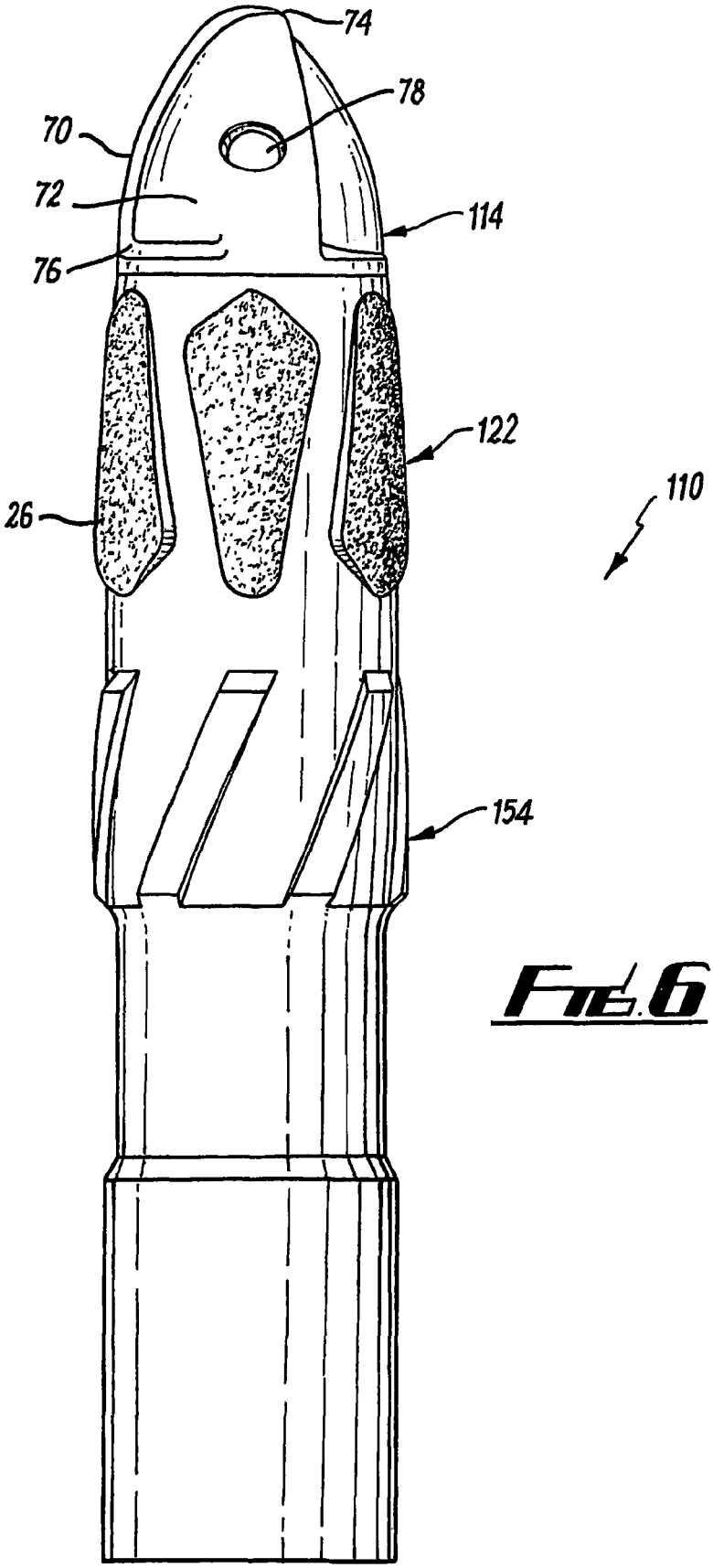
FIG. 6 is a schematic illustration of a shoe according to a second embodiment of the present invention.

An alternative embodiment of the shoe 10, is illustrated in FIG. 6 as shoe 110. Like parts to those of FIGS. 1 to 5 have been given the same reference numeral with the addition of 100. Shoe 110 has a nose portion 114, a reaming portion 122 and a stabiliser portion 154. The reaming portion 122 and the stabiliser 154 are identical to those described with reference to FIGS. 1 to 5. In this embodiment the nose portion 114 is provided with three blades 70 on the outer surface 72 thereof. The blades meet at an apex 74 of the nose at the forward end of the shoe 110 and splay back towards the reaming portion 122 so that their trailing ends 76, are equidistantly spaced around the circumference of the body 112. Flow ports 78 are also arranged between neighbouring blades 70. Any number of blades may be used, however, it may be advantageous to have a trailing edge 76 aligned with an apex 30 of the reaming members 26 so that cuttings from the blades 70 are directed into the funnels 42.

The blades 70 are made from a relatively soft material such as aluminium or a non-metal. The apex 74 pilots the shoe through the drilled well bore to aid in breaking through shale/clay stone bridges and other obstructions. The choice of material makes the nose 114 easy to drill through when the liner is in position and is cheaper than the current drill bits which are located on some shoes to drill a well bore and run a liner in a single trip.

The principal advantage of the present invention is that it provides a shoe for use on the end of a work string within a well bore which can be rotated and reciprocated without the problems experienced by the shoes of the prior art.

It will be appreciated that modifications and improvements may be made to the embodiment hereinbefore described without departing from the scope of the invention. For example, the embodiments described relate to a reamer shoe guiding a casing string through a well bore, those skilled in the art will appreciate that any guide shoe and string combination is within the scope of the invention. For example a guide shoe and a drill string may be used.

I claim:

1. A shoe for use on the end of a work string-after drilling a well bore, the shoe comprising a generally cylindrical body having a first end adapted for connection to the end of the work string and a second end including a nose portion; the nose portion including a rounded head distal to the body for advancement through the well bore; the body having thereupon a reaming portion located behind the nose portion wherein the reaming portion comprises a plurality of raised members, each pair of raised members being mounted oppositely, in parallel and longitudinally along the body, wherein each adjacent pair of members provides a funnel for collecting approaching debris and a channel for grinding the debris.

2. A shoe as claimed in claim 1 wherein the reaming members are elongate and continuous.

3. A shoe as claimed in claim 1 wherein the reaming members are teardrop shaped.

4. A shoe as claimed in claim 1 wherein the funnel comprises diverging edges of adjacent reaming members.

5. A shoe as claimed in claim 1 wherein the channel provided between each pair of members converges from the nose portion along the reaming portion.

6. A shoe as claimed in claim 1 wherein the nose portion is eccentric to aid the passage of the shoe through the well bore.

7. A shoe as claimed in claim 1 wherein the nose portion includes one or more ports.

8. A shoe as claimed in claim 1 wherein the nose portion includes a plurality of blades extending from the end of the nose towards the reaming portion.

9. A shoe as claimed in claim 8 wherein the blades include a cutting surface to assist in breaking through bridges.

10. A shoe as claimed in claim 1 wherein the shoe further comprises a gauge portion located furthest from the nose portion.

11. A shoe as claimed in claim 10 wherein the gauge portion is a stabiliser.

12. A shoe as claimed in claim 10 wherein the gauge portion comprises a plurality of elongate blades.

13. A shoe as claimed in claim 12 wherein the elongate blades are arranged helically along the body.

14. A shoe as claimed in claim 1 wherein the shoe is constructed from a combination of relatively hard and relatively soft materials.

15. A shoe as claimed in claim 1 wherein the workstring comprises tubing connected to the shoe.

16. A shoe for use on the end of a work string after drilling a well bore, the shoe comprising a generally cylindrical body having a first end adapted for connection to the end of the work string and a second end including a nose portion; the nose portion including a rounded head distal to the body for advancement through the well bore and a plurality of blades extending from the head towards the body; the body having thereupon a reaming portion located behind the nose portion wherein the reaming portion comprises a plurality of discrete raised members to ream the bore, wherein the raised members are arranged to be mounted oppositely, in parallel and longitudinally along the body, wherein each adjacent pair of members provides a funnel for collecting approaching debris and a channel for grinding the debris.

17. A shoe as claimed in claims 16 wherein the blades include a cutting surface to assist in breaking through bridges.

18. A shoe as claimed in claim 16 wherein the raised members are elongate and continuous.

19. A shoe as claimed in claim 16 wherein the reaming members are teardrop shaped.

20. A shoe as claimed in claim 16 wherein the funnel comprises diverging edges of adjacent reaming members.

21. A shoe as claimed in claim 16 wherein the channel provided between each pair of members converges from the nose portion along the reaming portion.

22. A shoe as claimed in claim 16 wherein the nose portion includes one or more ports.

23. A shoe as claimed in claim 16 wherein the shoe further comprises a gauge portion located furthest from the nose portion.

24. A shoe as claimed in claim 23 wherein the gauge portion is a stabiliser.

25. A shoe as claimed in claim 23 wherein the gauge portion comprises a plurality of elongate blades.

26. A shoe as claimed in claim 25 wherein the elongate blades are arranged helically along the body.

27. A shoe as claimed in claim 16 wherein the shoe is constructed from a combination of relatively hard and relatively soft materials.

28. A shoe as claimed in claim 16 wherein the workstring comprises tubing connected to the shoe.

29. A shoe for use on the end of a work string within a well bore, the shoe comprising a generally cylindrical body having a first end adapted for connection to the end of the work string and a second end including a nose portion; the nose portion including a rounded head distal to the body for advancement through the well bore and a plurality of blades extending from the head towards the body; the body having thereupon a reaming portion located behind the nose portion wherein the reaming portion comprises a plurality of discrete raised members to ream the bore, wherein the raised members are arranged to be mounted oppositely, in parallel and longitudinally along the body, wherein each adjacent pair of members provides a funnel for collecting approaching debris and a channel for grinding the debris, wherein the funnel comprises diverging edges of adjacent reaming members, wherein the channel provided between each pair of members converges from the nose portion along the reaming portion.

* * * * *